US006713993B2

(12) United States Patent
Descombes

(10) Patent No.: US 6,713,993 B2
(45) Date of Patent: Mar. 30, 2004

(54) HIGH-VOLTAGE REGULATOR INCLUDING AN EXTERNAL REGULATING DEVICE

(75) Inventor: Arthur Descombes, Kerzers (CH)

(73) Assignee: EM Microelectronic-Marin SA, Marin (CH)

( * ) Notice: Subject to any disclaimer, the term of this patent is extended or adjusted under 35 U.S.C. 154(b) by 0 days.

(21) Appl. No.: 10/178,710

(22) Filed: Jun. 25, 2002

(65) Prior Publication Data

US 2002/0196007 A1 Dec. 26, 2002

(30) Foreign Application Priority Data

Jun. 25, 2001 (CH) ..... 1157/01

(51) Int. Cl.[7] ..... G05F 1/40
(52) U.S. Cl. ..... 323/273; 323/281; 307/31
(58) Field of Search ..... 323/280, 281, 323/273, 274; 307/31

(56) References Cited

U.S. PATENT DOCUMENTS 3,509,449 A * 4/1970 Andren ..... 323/280
3,611,335 A 10/1971 Ogden
3,753,079 A * 8/1973 Trilling ..... 323/278
3,913,082 A 10/1975 Hamm
4,254,372 A * 3/1981 Moore, Jr. ..... 323/277
4,319,179 A * 3/1982 Jett, Jr. ..... 323/281
4,346,342 A * 8/1982 Carollo ..... 323/276
4,704,572 A * 11/1987 Melbert ..... 323/275
6,426,659 B1 * 7/2002 Iliasevitch ..... 327/143
2003/0111987 A1 * 6/2003 Chen et al. ..... 323/282

OTHER PUBLICATIONS

Patent Abstracts of Japan, vol. 13, No. 9, Jan. 11, 1989 & JP 63 217231, Sep. 9, 1988.

* cited by examiner

*Primary Examiner*—Shawn Riley
(74) *Attorney, Agent, or Firm*—Sughrue Mion, PLLC

(57) ABSTRACT

A high-voltage regulator circuit (1) delivering at least a first regulated output voltage ($V_{REG1}$, $V_{REG2}$) from a high input voltage ($V_{HV}$), this regulator circuit including an external regulation device (2) including an input terminal (21) to which said high input voltage is applied, an output terminal (22) at which said first regulated output voltage is delivered, and a control terminal (23) connected to a control circuit (10) of the external regulation device. The external regulation device (2) is controlled by a differential amplifier (4) to the inputs of which are respectively applied a divided voltage proportional to the first regulated output voltage and a determined reference voltage ($V_{REF}$), the output of this differential amplifier controlling the conduction state of the external regulation device (2) through a high-voltage MOSFET transistor (3) connected via its drain to the control terminal (23) of the external regulation device (2).

15 Claims, 7 Drawing Sheets

1
~10V
$V_{REG1}$
$C_{EXT1}$
IR
200
210
3V
$V_{REG2} \equiv V_{DD}$
$C_{EXT2}$
14
10
100
101
102
106
$R_3$
151
$R_4$
152
105
104
$V_{REF}$
53
54
52
12
$R_{11}$
$R_{12}$
$R_2$
$R_1$
5
6
$V_{DD}$
BANDGAP REF
$V_{REF}$
$V_{SS}$
13
30
$R_0$
4
$V_{DD}$
OUT
3
22
2
23
JFET
21
11
15...50V
$V_{HV}$ 1
~10V
$V_{REG1}$
$C_{EXT1}$
IR
200
210
3V
$V_{REG2} \equiv V_{DD}$
$C_{EXT2}$
14
10
100
101
102
106
$R_3$
151
$R_4$
152
105
104
$V_{REF}$
53
55
56
54
12
$R_{11}$
$R_{121}$
$R_{122}$
$R_2$
5
6
8
7
$V_{DD}$
BANDGAP REF
$V_{SS}$
13
30
$R_0$
9
4
OUT_B
OUT
22
2
23
JFET
21
11
3*
3
15...50V
$V_{HV}$

HIGH-VOLTAGE REGULATOR INCLUDING AN EXTERNAL REGULATING DEVICE

TECHNICAL FIELD

The present invention concerns in general a high-voltage regulator circuit enabling at least a first regulated output voltage to be delivered from a high input voltage, in particular of the order of several tens of volts. More particularly, the present invention concerns a high-voltage regulator of this type in the form of an integrated circuit controlling an external regulating device.

BACKGROUND OF THE INVENTION

Various applications require the supply of a determined regulated voltage from a high input voltage, this regulated voltage being used in particular for powering the electronic circuits of an associated device. FIG. 1 shows a regulator circuit globally designated by the reference numeral 1 including an external regulating device 2, formed of a JFET transistor, and a control circuit 10 for this external regulating device 2. This regulating circuit 1 is designed to deliver a regulated output voltage $V_{REG}$ for powering an associated device, which is not shown. This regulated output voltage $V_{REG}$ is derived from a high level input voltage $V_{HV}$ of the order of several tens of volts, typically able to vary between 15 and 30 volts.

A voltage regulating circuit of this type is used in particular in smoke detection devices, as disclosed for example in European Patent document No. A1-0 759 602 for deriving a low level regulated voltage (for example 5 volts) necessary, amongst other things, for powering a microprocessor of the smoke detection device. In the scope of such an application, the line voltage powering the smoke detection devices is for example of the order of 15 to 30 volts.

Regulator circuit 1 of FIG. 1 typically includes a differential amplifier 4 one input of which is connected to the output of a voltage divider circuit 5, formed in this example of two resistors 51, 52 connected in series, the other input of differential amplifier 4 being connected to a reference cell 6 delivering a reference voltage $V_{REF}$. This reference cell 6 is typically a cell delivering a temperature stable reference bandgap voltage. The output of differential amplifier 4 is directly connected to the gate of the JFET transistor forming regulator device 2.

The arrangement illustrated in FIG. 1 thus assures that the voltage present at the output node of voltage divider circuit 5, namely the connection node between resistors 51 and 52, is substantially equal to reference voltage $V_{REF}$, the values R1, R2 of resistors 51 and 52 being chosen such that the regulated output voltage $V_{REF}$ of regulator circuit 1 has a determined value, for example of the order of 5 volts. This regulated voltage $V_{REF}$ powers in particular, differential amplifier 4 and reference cell 6 of regulator 1 as illustrated in FIG. 1.

One drawback of the regulator circuit of FIG. 1 lies in particular in the choice of external regulator device 2 and the costs of the regulator device. In the example of FIG. 1, it will be understood that the JFET transistor has to be chosen to resist relatively high drain-source voltages (in the example of the order of max. 25 volts), this drain-source voltage being in particular a function of the high input voltage $V_{HV}$ and regulated voltage $V_{REF}$ which one wishes to deliver at the output of the regulator. It will be noted that the cost of this JFET transistor increases with the maximum drain-source voltage to which the regulator element can be subjected. It is thus desirable, in particular with a view to reducing costs, to propose an alternative solution to the solution shown in FIG. 1.

Another drawback of the solution shown in FIG. 1 lies in the fact that the gate of the JFET transistor forming external regulator device 2 is directly controlled by the output of differential amplifier 4. The gate voltage of the JFET transistor is thus limited by the output voltage of differential amplifier 4, which is itself dependent on the technology used.

A serious drawback of the solution of FIG. 1 thus lies in the fact that its application is limited by the high input voltage capable of being applied to the regulator input and by the regulated output voltage which one wishes to deliver. Thus, if the high input voltage were increased and/or if the regulated output voltage were reduced, for example to 3 volts, the limits imposed by technology would make the use of the regulator circuit of FIG. 1 too expensive or even impossible, in particular when one wishes to manufacture this regulator in submicron technology.

SUMMARY OF THE INVENTION

The object of the present invention is thus to propose a solution allowing the aforementioned drawbacks to be overcome, and in particular to propose a solution allowing the use of a less expensive external regulator device and a solution able to be used with higher input voltages.

Another object of the present invention is to propose a solution able to be made and manufactured in a CMOS submicron technology, in particular in a 0.5 $\mu$m CMOS technology.

Generally, according to the present invention, the external regulator device is advantageously controlled via a specific high-voltage MOSFET transistor capable of seeing at its terminals a drain-source voltage of the order of several tens of volts. Consequently, the stress imposed on the regulator device and on the differential amplifier is lower, this involving in particular lower costs as regards the external regulator device.

Although the present invention requires the use of additional elements, the additional costs caused by the addition of these elements are nonetheless less than the saving that can be hoped for on the costs linked to the external regulator device. Further, the high-voltage MOSFET transistors used within the scope of the present invention are perfectly compatible with standard CMOS technology and require little or no masks and/or additional implantation in order to be manufactured.

According to a preferred embodiment of the present invention, the regulator circuit is arranged to deliver a first regulated output voltage, or intermediate voltage, and a second regulated output voltage for powering certain components of the regulator circuit, such as the differential amplifier and the regulator reference cell, and for powering the electronic circuits of any associated device, such as for example the microprocessor responsible for the operations of a smoke detection device. According to this preferred embodiment, the intermediate regulated voltage is for example used, within the scope of application to a smoke detection device, to supply the current necessary for generating the infrared pulse via the infrared diode typically fitted to such detection devices.

Within the scope of application in a smoke detector and unlike the regulator circuit of FIG. 1, it will be noted that this preferred embodiment of the present invention enables the infrared diode to be moved from the input to the output of the regulator circuit where the intermediate regulated voltage is delivered. The voltage necessary to generate an infrared voltage pulse in a smoke detection device is typically of the order of tens of volts, i.e. well higher than the voltage levels used to power the electronic circuits of the device. According to this embodiment of the invention, this regulated intermediate voltage is of a lower level than the input voltage of the regulator circuit, thus allowing a reduction in losses when the infrared pulse is generated, and nonetheless higher than the supply voltage of the electronic circuits in order to assure an adequate supply voltage for generating the infrared pulse.

According to another embodiment of the present invention, the regulator circuit is arranged such that the differential amplifier controlling the external regulation device has a hysteresis, assuring in particular increased stability in the operation of the regulator.

BRIEF DESCRIPTION OF THE DRAWINGS

Other features and advantages of the present invention will appear more clearly upon reading the following detailed description, made with reference to the annexed drawings, given by way of non-limiting example and in which.

EMBODIMENTS OF THE INVENTION

Figure 1:
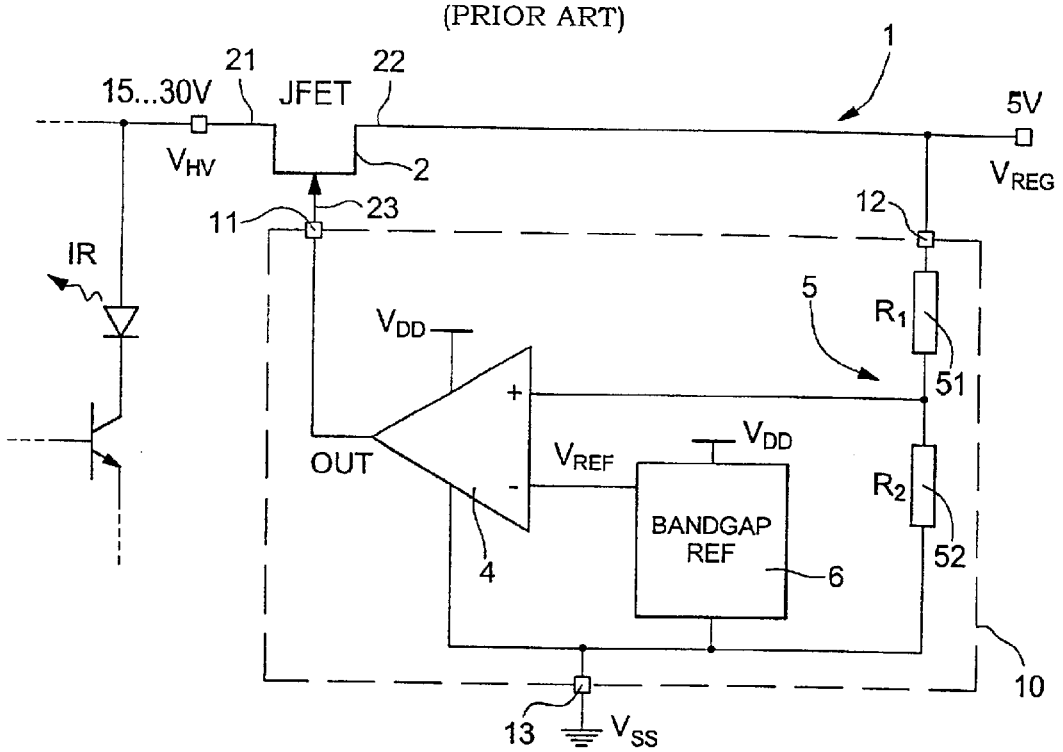
Fig.1 (PRIOR ART)
FIG. 1, which has already been presented, is a block diagram of a high-voltage regulator circuit of the prior art including an external regulation device formed of an n channel JFET transistor.
Figure 2:
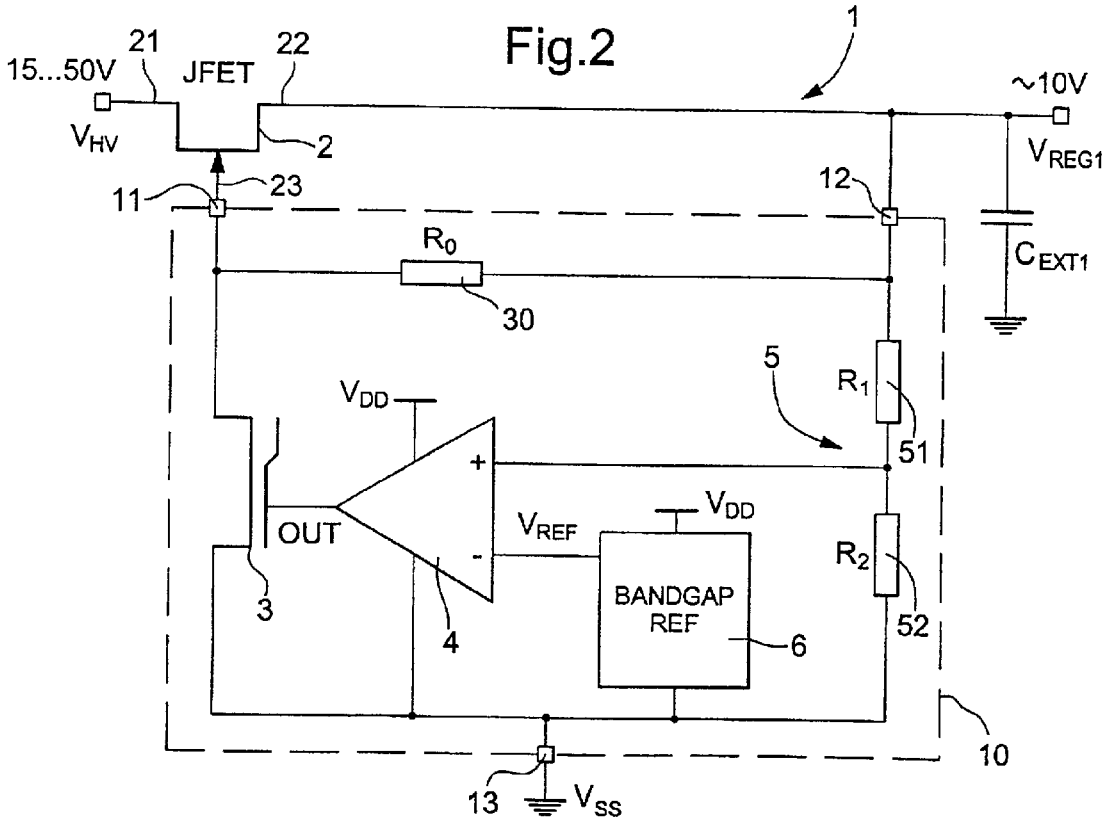
FIG. 2 is a general block diagram of a high-voltage regulator circuit according to the present invention including an external regulation device formed of an n channel JFET transistor.

FIG. 2 shows a general block diagram of a high-voltage regulator circuit according to the present invention for delivering a regulated high output voltage designated $V_{REG1}$. As previously, with reference to FIG. 1, this regulator is globally designated by the reference numeral 1 and includes, in particular, an external regulation device 2, formed in this example of a single n channel JFET transistor, and an integrated control circuit globally designated by the reference numeral 10, for example made in the form of an ASIC.

Within the scope of the specific application to a voltage regulator in a smoke detection device, the high input voltage $V_{HV}$ can vary in this example from approximately 15 to 50 volts. Regulated output voltage $V_{REG1}$ is of the order of ten volts in this example.

Figure 8:
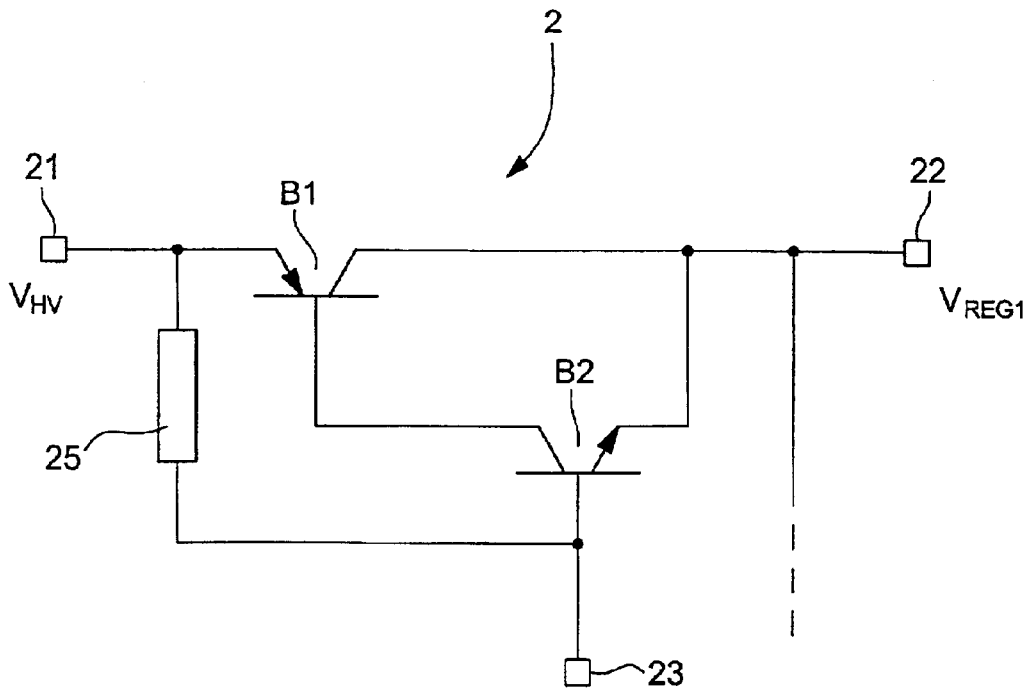
FIG. 8 is a diagram of an external regulation device capable of replacing the JFET transistor used as external regulation device in the regulator circuits of FIGS. 2, 4 and 5.

External regulation device 2 includes an input terminal 21 (the drain of the JFET transistor) connected to high input voltage $V_{HV}$, an output terminal (the source of the JFET transistor) on which the regulated output voltage $V_{REG1}$ is delivered, and a control terminal 23 (the gate of the JFET transistor) via which the conduction state of external regulation device 2 is controlled. Control terminal 23 and output terminal 22 are respectively connected to terminals 11 and 12 of integrated circuit 10. A terminal 13 of integrated circuit 10 is connected to ground $V_{SS}$ of the circuit. It will already be noted here that other external regulation devices could be used instead of the JFET transistor. FIG. 8, which will be discussed in detail hereinafter, has for example, another external regulation device including an arrangement of two complementary bipolar transistors and a resistor.

Integrated circuit 10 essentially includes a differential amplifier 4, a voltage divider circuit 5, a reference cell 6, and a high-voltage control element 3. Voltage divider circuit 5 is formed in this example of two resistors 51, 52 connected in series between terminal 12 of integrated circuit 10, namely the output terminal of external regulation device 2, and ground $V_{SS}$ of the circuit. It is of course clear that other voltage divider circuits could be used by those skilled in the art. Regulator circuit 1 further typically includes an external capacitive element $C_{EXT1}$ forming a buffer connected to output terminal 22.

The connection node between the two resistors 51, 52 is connected to a first output terminal of differential amplifier 4. It will easily have been understood that the voltage applied to this first input terminal of differential amplifier 4 and regulated voltage $V_{REG1}$ are proportional in a ratio determined by the values R1 and R2 of resistors 51, 52. The second input terminal of differential amplifier 4 is connected to reference cell 6 generating a reference voltage designated $V_{REF}$, this reference cell 6 typically being a bandgap type cell, delivering a reference voltage for example of the order of approximately 1.2 volts.

The output of differential amplifier 4 is applied to the gate of a high-voltage MOSFET transistor 3 of a specific type. This high-voltage MOSFET transistor, which is of the n channel type here, is already known to those skilled in the art. The peculiarity of this high-voltage transistor lies in particular in the specific structure of the gate oxide which has a greater thickness on the drain side than on the source side and in the presence of a buffer zone on the drain side formed of an n type well (or p type for a high-voltage p-channel MOSFET transistor).

Figure 3A:
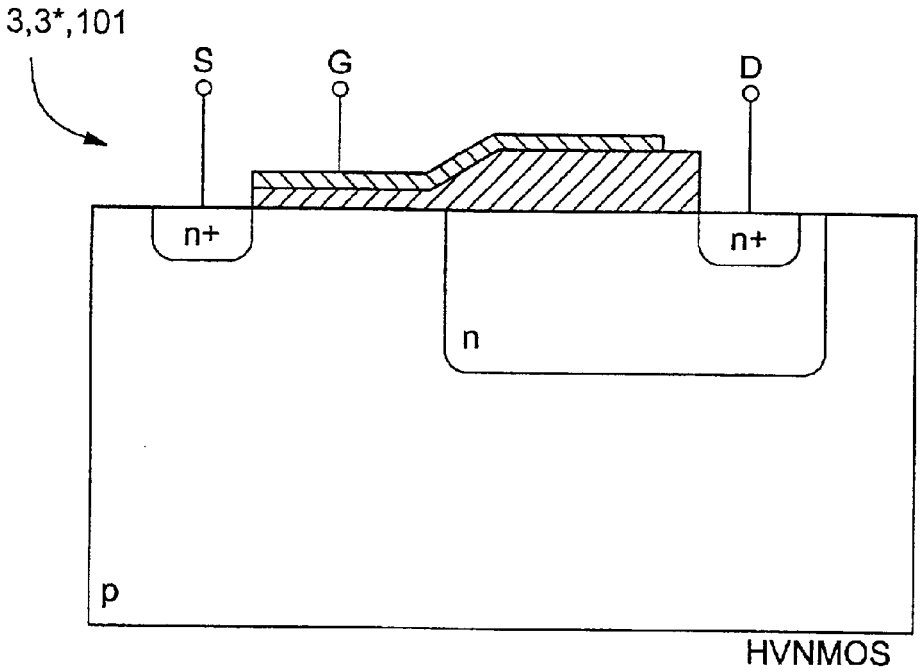
FIGS. 3*a* and 3*b* are schematic cross-sections of, respectively n channel and p channel, high-voltage MOSFET transistors, made in accordance with standard CMOS technology.
Figure 3B:
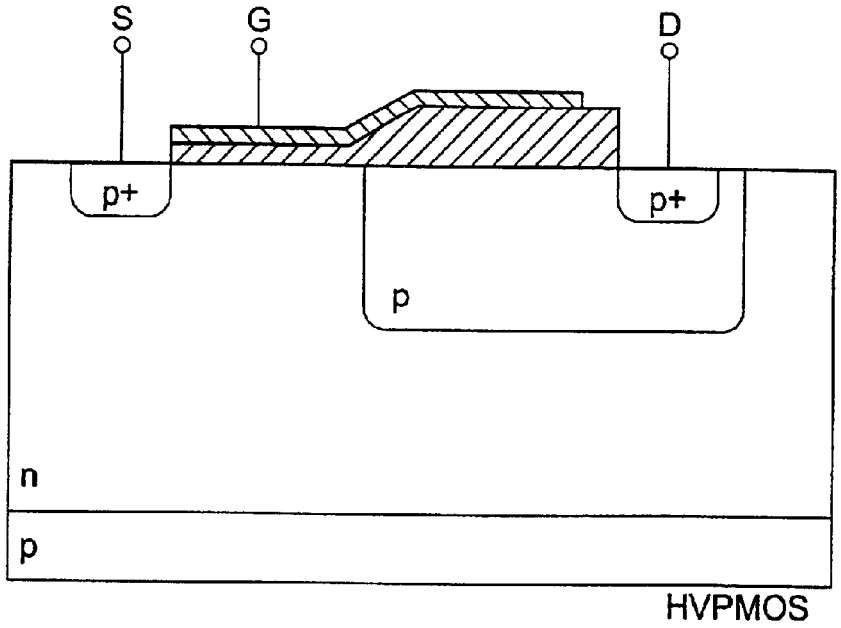

FIGS. 3*a* and 3*b* respectively show diagrams of a high-voltage n-channel MOSFET transistor or HVNMOS, and of a high-voltage p-channel MOSFET transistor, or HVPMOS. HVNMOS transistors have, in particular, the advantage of a high breakdown voltage, typically higher than 30 volts. Another advantage of this type of transistor lies in the fact that the manufacture thereof is perfectly compatible with standard CMOS technology.

For further details concerning this type of high-voltage transistor, reference can be made to the article by M M. C. Bassin, H. Ballan and M. Declercq entitled "High-Voltage Devices for 0.5 $\mu$m Standard CMOS Technology", IEEE Electron Device Letters, vol. 21, No. 1, January 2000, relating to the manufacture of such high-voltage transistors in 0.5 micron technology. By way of example, it is clear from Table 1 of this document that a high-voltage n-channel MOSFET transistor having a breakdown voltage of the order of 30 volts can be made in standard CMOS technology without requiring additional masks or implantations.

With reference again to FIG. 2, it can be seen that high-voltage MOSFET transistor 3 is connected, on the drain side, to control terminal 23 of external regulation device 2 via terminal 11, and, on the source side, to ground $V_{SS}$ via terminal 13. In order to assure adequate polarisation of the JFET transistor forming external regulation device 2, a resistor 30 of value R0 is connected between terminals 11 and 12 of integrated circuit 10, namely between control terminal 23 and output terminal 22 of external regulation device 2. It will be noted that this resistor 30 is only necessary in the event that external regulation device 2 is formed of a JFET transistor as illustrated. In the event that the external regulation device is made in the form of an arrangement of bipolar transistors as illustrated in FIG. 8, this resistor 30 is no longer necessary.

In FIG. 2, it will be noted that differential amplifier 4, and reference cell 6 are powered by a supply voltage $V_{DD}$, for example of the order of 3 volts. In the following description, according to a variant of the present invention, this supply voltage $V_{DD}$ is advantageously also delivered by regulator circuit 1 itself.

According to the invention, it will be noted that the only elements that have to withstand high voltages at their terminals are transistor 3 and resistors 30, 51 and 52, the latter being advantageously integrated in the form of n-type diffusions or n-well resistors. Differential amplifier 4 is a conventional differential amplifier which only has to withstand low voltages at its terminals.

Figure 4:
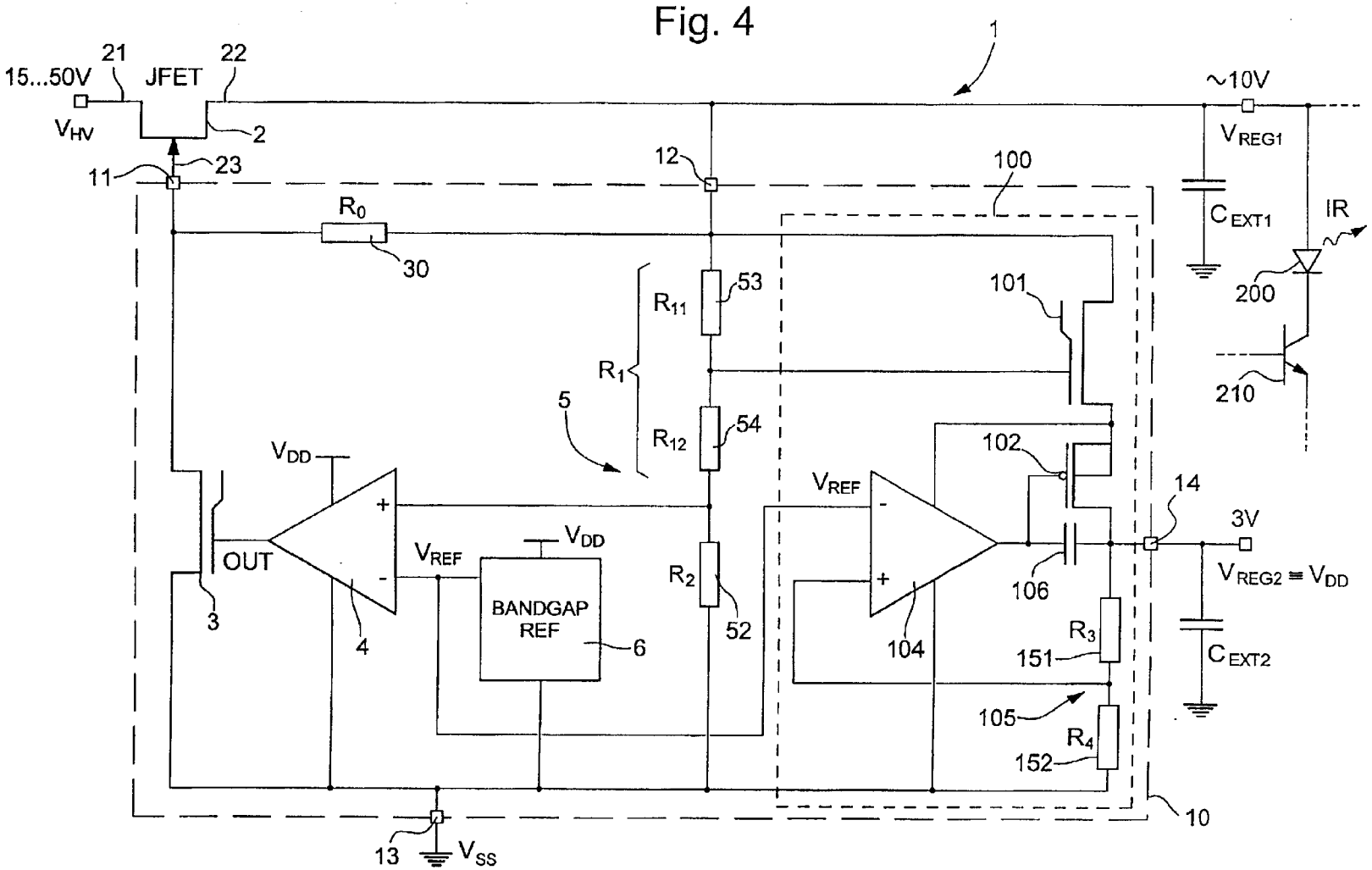
FIG. 4 shows a first variant embodiment of the high-voltage regulator circuit according to the invention, allowing a first intermediate level regulated output voltage and a second low or nominal level regulated output voltage to be delivered for powering electronic components.

FIG. 4 shows an advantageous variant of the regulator circuit according to the invention wherein integrated circuit 10 further includes means, globally designated by the reference numeral 100, for delivering a second regulated output voltage $V_{REG2}$ advantageously for powering various electronic components of the regulator circuit, such as, in particular, differential amplifier 4 and reference cell 6, or other electronic components associated with the regulator. In FIG. 4, it will be noted that the regulated output voltage $V_{REG2}$ is used as supply voltage $V_{DD}$ for differential amplifier 4 and reference cell 6.

Means 100 preferably include, as illustrated, a second high-voltage n-channel MOFSET transistor designated by the reference numeral 101, a regulation element 102 formed in this example of a p-MOS transistor, a differential amplifier 104 and a voltage divider circuit 105.

High-voltage MOFSET transistor 101 is similar to transistor 3 and is connected, via its drain terminal, to output terminal 22 of external regulation device 2, and, via its source terminal to the source terminal of p-MOS transistor 102. The gate of high-voltage MOFSET transistor 101 is connected to voltage divider circuit 5 at the connection node between resistors 53 and 54. These resistors 53 and 54 in series replace resistor 51 of FIG. 2 and the sum of values R11 and R12 of resistors 53 and 54 is equivalent to the value R1 of resistor 51 of FIG. 2. The division ratio of voltage divider circuit 5 thus remains unchanged as regards the voltage applied to the input of differential amplifier 4.

The ratio of resistors R11, R12 and R2 is chosen such that the voltage applied to the gate of high-voltage transistor 101 causes a determined potential drop between the drain and source of transistor 101, the voltage present at the source of transistor 101 then being representative of output voltage $V_{REG1}$ less the determined potential drop present at the terminals of transistor 101. It will thus be understood that the essential role of high-voltage transistor 101 is to lower output voltage $V_{REG1}$ to a tolerable level for the circuits located downstream.

Voltage divider circuit 105 is formed in this example of the series arrangement, between the drain terminal of p-MOS transistor 102 and ground $V_{SS}$, of two resistors 151 and 152, the division ratio of this divider circuit 105 being determined by the values R3 and R4 of these resistors. The second regulated output voltage $V_{REG2}$ is delivered at a terminal 14 of integrated circuit 10 to the drain terminal of p-MOS transistor 102 at the terminals of voltage divider circuit 105, a second capacitive buffer element $C_{EXT2}$ typically being connected to this terminal 14.

The connection node between the two resistors 151 and 152 is connected to a first input terminal of differential amplifier 104. The voltage applied to this first input terminal of differential amplifier 104 and the second regulated output voltage $V_{REG2}$ are proportional in a ratio determined by the values R3 and R4 of resistors 151 and 152. The second input terminal of differential amplifier 104 is connected, in a similar way to differential amplifier 4, to reference cell 6 generating reference voltage $V_{REF}$.

The output of differential amplifier 104 is applied to the gate of p-MOS transistor 102. It will again be understood that the arrangement of differential amplifier 104 illustrated in FIG. 4 sets the voltage present at the output node of voltage divider circuit 105, namely the connection node between resistors 151 and 152, to be substantially equal to reference voltage $V_{REF}$, the values R3 and R4 of the resistors being chosen such that the second regulated output voltage $V_{REG2}$ of regulator circuit 1 has a determined value, for example of the order of 3 volts. This regulated voltage $V_{REG2}$ powers, in particular, differential amplifier 4 and reference cell 6 of regulator 1 as already mentioned.

Unlike differential amplifier 4, differential amplifier 104 is supplied, on the one hand, by ground $V_{SS}$ and, on the other hand, by the voltage present at the source terminal of p-MOS transistor 102. Advantageously, a capacitive element 106 is arranged at the output of differential amplifier 104 between the gate and drain terminals of p-MOS transistor 102. This capacitive element 106 assures the stability of regulated output voltage $V_{REG2}$.

Within the specific scope of an application to a smoke detector, the regulator circuit according to the invention allows the infrared diode of the detector, necessary for generating the infrared pulse, to be moved from the input to the output of the regulator circuit at terminal 12 of the circuit where regulated output voltage $V_{REG1}$ is delivered. FIG. 4 shows schematically the arrangement of this infrared diode indicated by the reference numeral 200 and of control means 210 mounted in series with diode 200, here a bipolar transistor, triggering the infrared pulse.

Compared to the solution of the prior art of FIG. 1, the present invention thus allows a reduction in losses during generation of the infrared pulse, in particular, since the regulated voltage used for such generation is less than the input voltage. By means of the solution of FIG. 1, it will be recalled that the infrared diode and its control means are placed at high-voltage input 21, the regulated output voltage not being sufficient to power this infrared diode and allow the required pulse generation.

Figure 6:
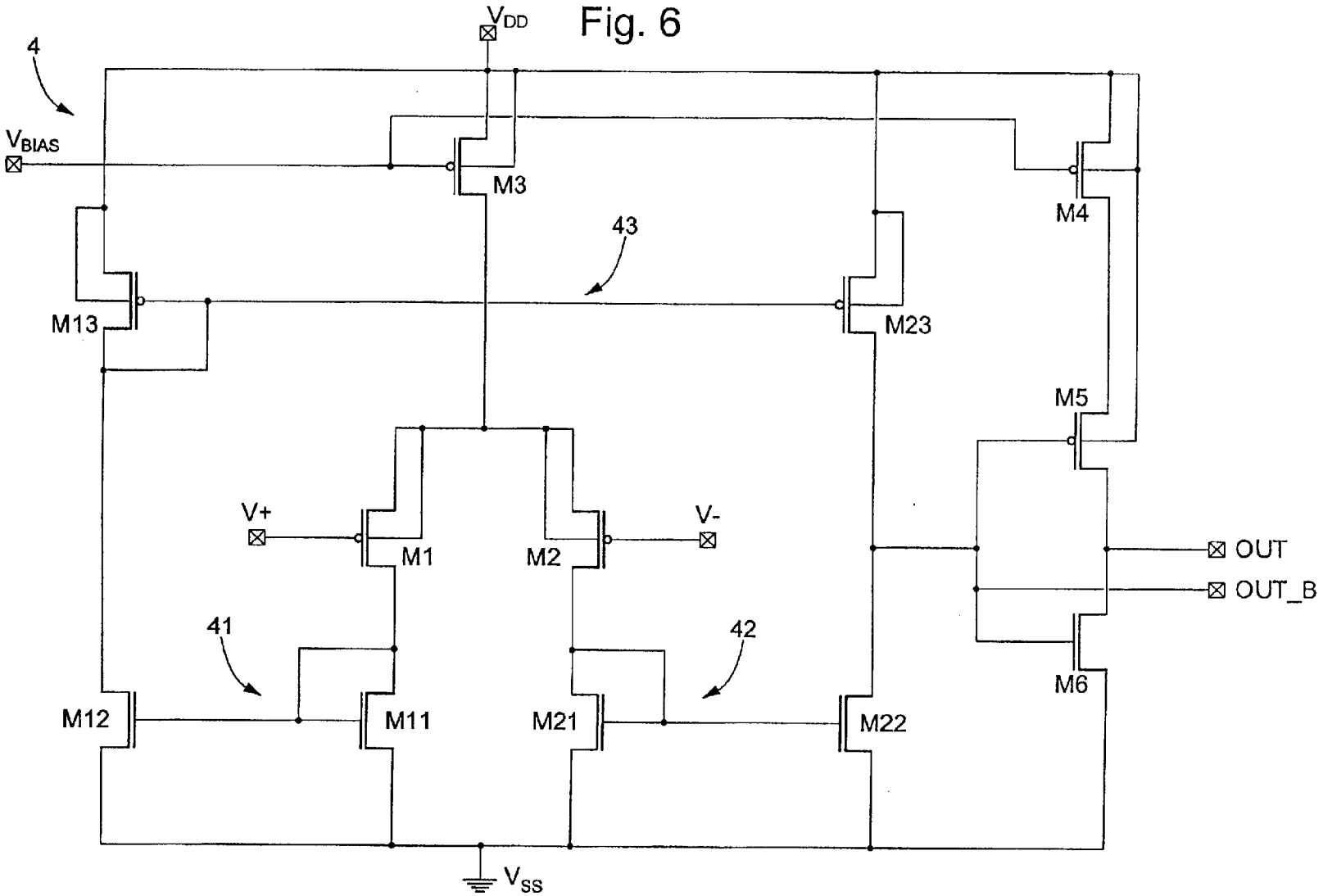
FIG. 6 is a detailed diagram of an example embodiment of the differential amplifier controlling the external regulation device.

As already mentioned, the differential amplifier 4 used in the regulation circuit of FIG. 2 or 4 is a conventional type of differential amplifier, an example embodiment of which is shown in FIG. 6. The differential amplifier 4 illustrated in FIG. 6 includes a differential pair of transistors M1, M2 (in this case two identical p-MOS transistors), the gates of which form the inputs of differential amplifier 4. Each transistor M1, M2 is connected in series in the reference branch of a current mirror 41, 42, each current mirror 41, 42 including in a conventional manner, two n-MOS transistors M11, M12 and M21, M22 connected gate-to-gate. Transistors M12 and M22 of the output branches of current mirrors 41 and 42 are themselves respectively connected in the reference and output branches of another current mirror designated globally by the reference numeral 43 and including two p-MOS transistors M13 and M23. The output of differential amplifier 4 is formed of the connection node between p-MOS transistor M23 and n-MOS transistor M22 of the output branch of current mirror 43.

A p-MOS transistor M3 connected between the supply terminal $V_{DD}$ and the connection node of p-MOS transistors M1, M2 of the input differential pair assures adequate bias of the transistors, a determined bias voltage $V_{BIAS}$ being applied to the gate of p-MOS transistor M3.

In the illustration of FIG. 6, differential amplifier 4 further includes an additional output stage including p-MOS transistor M5 and n-MOS transistor M6 forming a inverter arrangement for delivering the output signal designated OUT and its reverse OUT_B, a p-MOS transistor M4 controlled by bias voltage $V_{BIAS}$ being connected in series with these transistors M5, M6 in order to assure adequate bias thereof. Consequently, differential amplifier 4 forms a comparator delivering logic level signals at its output.

It should be mentioned that the structure of differential amplifier 4 illustrated in FIG. 6 is given solely by way of example and that other configurations could be envisaged by those skilled in the art.

Figure 7:
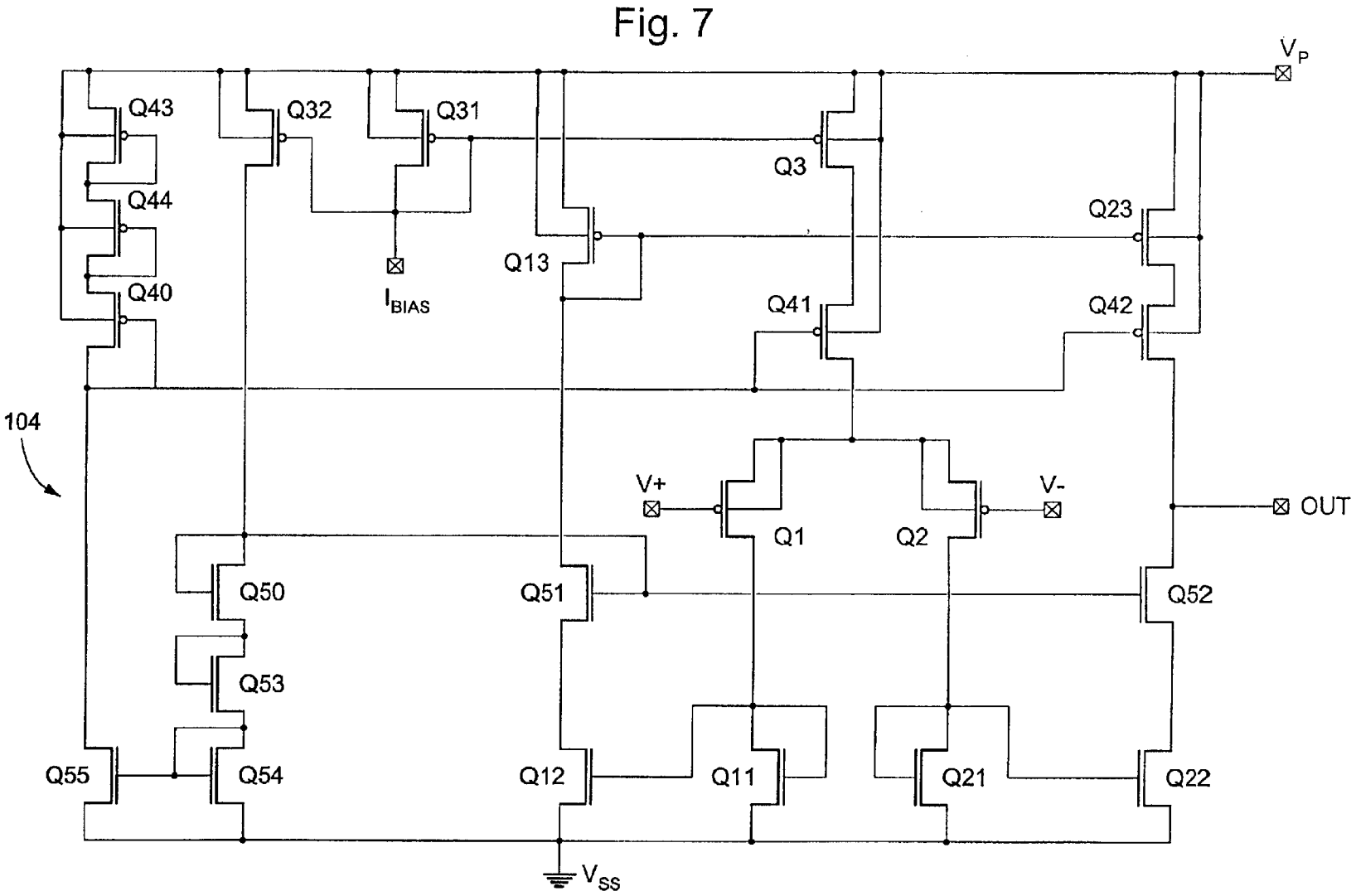
FIG. 7 is a detailed diagram of an example embodiment of the differential amplifier of the regulator circuit of FIGS. 4 and 5 used to produce the second low level regulated output voltage.

The differential amplifier 104 used in the regulator circuit of FIG. 4 has to be designed to tolerate higher voltages at its terminals and can be made on the basis of a similar diagram to the differential amplifier 4 of FIG. 6 by using cascode connections that are well known to those skilled in the art, i.e. two or more transistors connected in series. FIG. 7 shows an example embodiment of such a differential amplifier using cascode circuit techniques.

Transistors Q1, Q2, Q11, Q12, Q21, Q22, Q13, Q23 and Q3 fulfil essentially the same roles as transistors M1, M2, M11, M12, M21, M22, M13, M23 and M3 of the circuit of FIG. 6. Cascode circuits are used in order to limit the voltages capable of appearing at the terminals of the transistors of this differential amplifier 104, in particular, the transistors connected between supply voltages VP and VSS. It will be noted that voltage VP is extracted from the source of high-voltage MOSFET transistor 101. Thus transistors Q12 and Q22 are each connected in series respectively with a second n-MOS transistor Q51 arranged between transistors Q12 and Q13 and a second n-MOS transistor Q52 arranged between transistors Q22 and Q23. Likewise, transistors Q3 and Q23 are each connected in series with a second p-MOS transistor Q41 arranged between transistor Q3 and the connection node of the differential pair and a second p-MOS transistor Q42 arranged between transistors Q22 and Q23. The output terminal of differential amplifier 104 is formed of the connection node between transistors Q42 and Q52.

An additional n-MOS transistor Q50, in a conventional manner, forms a current mirror with transistors Q51 and Q52. Likewise, an additional p-MOS transistor Q40, in a conventional manner, forms a current mirror with transistors Q41 and Q42. Each of these transistors Q40 and Q50 is connected in series with a cascode circuit of two, respectively p-MOS transistors Q43, Q44 and n-MOS transistors Q53, Q54. The n-MOS transistor Q54 also forms a current mirror with another n-MOS transistor Q55 connected in series in the branch including the p-MOS transistors Q40, Q43 and Q44.

The bias of the transistors is fixed by a bias current $I_{BIAS}$ applied in the current path of a p-MOS transistor Q31 connected in mirror current to transistor Q3, this bias current $I_{BIAS}$ being itself mirrored in the branch including n-MOS transistors Q50, Q53 and Q54 by means of a p-MOS transistor Q32.

The circuit illustrated in FIG. 7 assures that none of the transistors of differential amplifier 104 has too high a voltage at its terminals capable of causing the transistor to breakdown.

Just like differential amplifier 4 of FIG. 6, the configuration of FIG. 7 is given solely by way of example, those skilled in the art being capable of making numerous modifications to the diagram shown, or of choosing an alternative configuration. It will be noted that differential amplifier 104 must essentially answer higher stresses than differential amplifier 4 given that the latter is powered by a higher voltage, in this example typically of the order of 4 to 7 volts.

Figure 5:
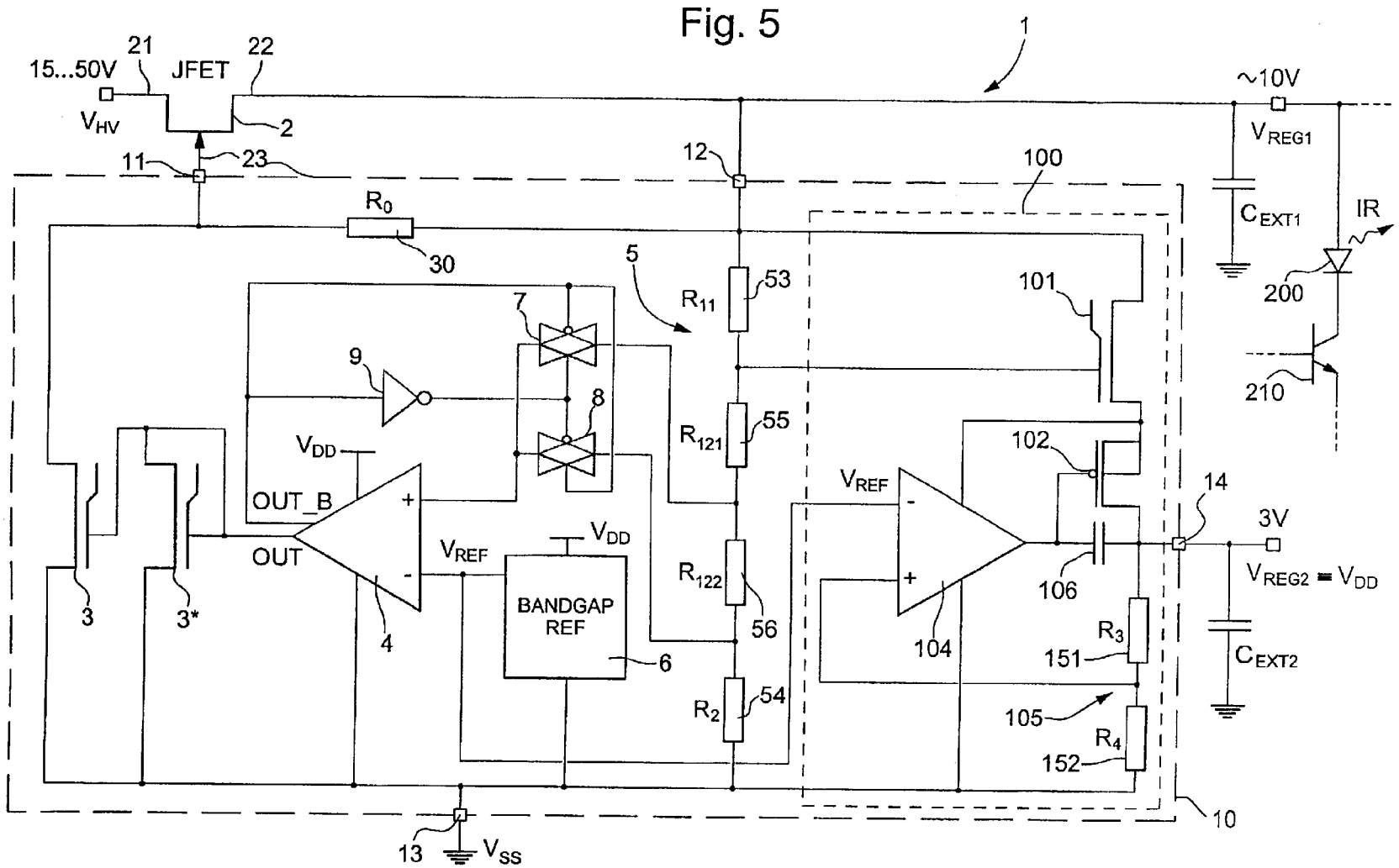
FIG. 5 shows a second variant embodiment of the high-voltage regulator circuit according to the invention wherein the differential amplifier controlling the external regulation device also has a hysteresis.

FIG. 5 shows another advantageous variant of the regulator circuit according to the invention substantially similar to the variant of FIG. 4. In addition to the means for delivering the second regulated output voltage $V_{REG2}$, the differential amplifier 4 of regulator circuit 1 is arranged to have a hysteresis. This hysteresis has the advantage of making the stability of the regulator less critical and consequently a periodic variation in first regulated voltage $V_{REG1}$. The regulator of FIG. 5 consequently forms a bang-bang type regulator delivering a regulated voltage varying between two determined voltage levels. It will also be noted that, in this example, differential amplifier 4 forms a comparator, i.e. it supplies output logic level signals OUT and OUT_B.

The hysteresis of the differential amplifier can be generated in various ways. One of these is illustrated schematically in FIG. 5 and uses two transmission gates 7 and 8 connected to the input on which the output voltage of voltage divider circuit 5 is applied, and an inverter 9, connected on the output of differential amplifier 4. Compared to the variant illustrated in FIG. 4, divider circuit 5 is also slightly modified such that resistor 54 is subdivided into two resistors 55 and 56, the sum of whose values $R_{121}$ and $R_{122}$ is equivalent to the value $R_{12}$ of resistor 54 of FIG. 4. The hysteresis is determined by the ratio of values $R_{11}$, $R_{121}$, $R_{122}$ and $R_2$ of resistors 53, 55, 56 and 52.

The connection node between resistors 55 and 56 is connected to the input of the first transmission gate 7 and the connection node between resistors 56 and 52 is connected to the input of the second transmission gate 8. The state of transmission gates 7 and 8 is controlled as a function of the output of differential amplifier 4, transmission gates 7 and 8 being respectively conductive and non-conductive when the (non-inverted) output signal from differential amplifier 4 is in the high state and, conversely, respectively non-conductive and conductive when the output signal from differential amplifier 4 is in the low state. In this case, the inverted output OUT_B of differential amplifier 4 is connected to the inverting terminal of gate 7 and the non-inverting terminal of gate 8, the inverted output OUT_B being also applied, via inverter 9, to the non-inverted terminal of gate 7 and the inverted terminal of gate 8.

Within the scope of the embodiment of FIG. 5, it is also advantageous to control external regulation device 2 via a current mirror formed of two high-voltage n-channel MOSFET transistors, namely the aforementioned transistor 3 and a similar high-voltage transistor, designated 3*, whose gate and drain are connected together at the output of differential amplifier 4.

Finally, as already mentioned hereinbefore, the JFET transistor used as external regulation device 2 in the embodiments described hereinbefore could be replaced by another suitable device. For example, the JFET transistor could advantageously be replaced by the device illustrated in FIG. 8 formed of a pseudo-Darlington circuit including two complementary bipolar transistors, namely a pnp type bipolar transistor B1 and an npn type bipolar transistor B2. It will be noted that a Darlington circuit including two bipolar transistors of the same type could alternatively be used instead of the pseudo-Darlington circuit of FIG. 8.

In the illustration of FIG. 8, the emitter and collector of transistor B1 respectively form input 21 at which high input voltage $V_{HV}$ is applied and output 22 at which regulated output voltage $V_{REG1}$ is supplied, the base of this transistor B1 being connected to the collector of bipolar transistor B2, the emitter of transistor B2 being connected to the collector of transistor B1. The base of transistor B2 forms the control terminal 23 of the external regulation device. It will be noted that this external regulation device 2 further includes a resistor 25 connected in parallel between input terminal 21 and control terminal 23.

Although the device illustrated in FIG. 8 includes a higher number of components, the costs of this device are nonetheless lower than the costs linked to the use of a JFET transistor, this thus forming an advantage with a view to reducing the manufacturing costs of the regulator circuit.

Numerous modifications and/or improvements to the present invention may be envisaged without departing from the scope of the invention defined by the annexed claims. In particular, the regulator circuit according to the invention is in no way limited by the type of external regulation device used in the aforementioned embodiments, namely, a JFET transistor. As mentioned, other suitable arrangements, such as the arrangement of FIG. 8, can be used by those skilled in the art.

What is claimed is:

1. A high-voltage regulator circuit for delivering at least a first regulated output voltage ($V_{REG1}$, $V_{REG2}$) from a high input voltage ($V_{HV}$), this regulator circuit including an external regulation device including an input terminal to which said high input voltage is applied, an output terminal at which said first regulated output voltage is delivered, and a control terminal connected to a control circuit of said external regulation device, this control circuit including:

a voltage divider circuit connected between said output terminal and a reference potential ($V_{SS}$) or ground, and delivering at one output a first divided voltage proportional, in a determined ratio, to said first regulated output voltage ($V_{REG1}$);

a reference cell delivering at one output a determined reference voltage ($V_{REF}$); and a differential amplifier including first and second inputs to which are respectively applied said first divided voltage delivered by the voltage divider circuit and said reference voltage ($V_{REF}$) delivered by the reference cell, the output of this differential amplifier controlling the conduction state of said external regulation device, wherein said control circuit further includes a first high-voltage MOSFET transistor including drain, source and gate terminals respectively connected to the control terminal of the external regulation device, to ground ($V_{SS}$), and to the output of said differential amplifier, said high-voltage MOSFET transistor being an n-channel MOSFET transistor including a gate oxide having a greater thickness on the drain side than on the source side and a buffer zone on the drain side formed by an n-well.

2. The regulator circuit according to claim 1, wherein said control circuit further includes means for delivering a second regulated output voltage ($V_{REG2}$) powering at least said differential amplifier and said reference cell.

3. The regulator circuit according to claim 2, wherein said means include:

a second high-voltage MOSFET transistor including drain, source and gate terminals, the drain and gate terminals of said high-voltage MOSFET transistor being respectively connected to the output terminal of the external regulation device and to a second output of the voltage divider circuit delivering a second divided voltage proportional, in a determined ratio, to said first regulated output voltage ($V_{REG1}$);

a p-channel MOSFET transistor including drain, source and gate terminals, the source terminal of said p-channel MOSFET transistor being connected to the source terminal of the second high-voltage MOSFET transistor, said second regulated output voltage ($V_{REG2}$) being delivered at the drain terminal of said p-channel MOSFET transistor;

a second voltage divider circuit connected between the drain terminal of said p-channel MOSFET transistor and ground ($V_{SS}$), and delivering at one output a divided voltage proportional, in a determined ratio, to said second regulated output voltage ($V_{REG2}$); and a second differential amplifier including first and second inputs to which are respectively applied said divided voltage delivered by said second voltage divider circuit and said reference voltage ($V_{REF}$) delivered by the reference cell, the output of said second differential amplifier being connected to the gate terminal of the p-channel MOSFET transistor, said second differential amplifier being powered by the voltage present at the connection node between the source terminals of said second high-voltage MOSFET transistor and said p-channel MOSFET transistor.

4. The regulator circuit according to claim 1, wherein said differential amplifier controlling the conduction state of the external regulation device is arranged to have a hysteresis such that said first regulated voltage ($V_{REG1}$) varies between first and second determined voltage levels.

5. The regulator circuit according to claim 4, wherein said control circuit includes an additional high-voltage MOSFET transistor including drain, source and gate terminals, said additional high-voltage MOSFET transistor forming, with said first high-voltage MOSFET transistor, a current mirror, the drain and gate terminals of the additional high-voltage MOSFET transistor being connected together to the gate terminal of the first high-voltage MOSFET transistor and the source terminal of the additional high-voltage MOSFET transistor being connected to ground ($V_{SS}$).

6. The regulator circuit according to claim 1, wherein the voltage divider circuit or circuits are resistive divider circuits.

7. The regulator circuit according to claim 1, wherein said external regulation device is a JFET transistor including drain, source and gate terminals respectively forming the input, output and control terminals of said external regulation device, and wherein said control circuit further includes a resistive element connected between the control and output terminals of said external regulation device.

8. The regulator circuit according to claim 1, wherein said external regulation device includes a Darlington or pseudo-Darlington circuit with two bipolar transistors.

9. The regulator circuit according to claim 8, wherein said external regulation device includes a pnp bipolar transistor and an npn bipolar transistor arranged in a pseudo-Darlington circuit, the base and the collector of the pnp transistor being respectively connected to the collector and the emitter of the npn bipolar transistor, the emitter of the pnp bipolar transistor, the collector of the pnp bipolar transistor and the base of the npn bipolar transistor respectively forming the input, output and control terminals of said external regulation device, a resistor further being connected between the emitter of the pnp bipolar transistor and the base of the npn bipolar transistor.

10. A high-voltage regulator circuit for delivering at least a first regulated output voltage ($V_{REG1}$, $V_{REG2}$) from a high input voltage ($V_{HV}$), this regulator circuit including an external regulation device including an input terminal to which said high input voltage is applied, an output terminal at which said first regulated output voltage is delivered, and a control terminal connected to a control circuit of said external regulation device, this control circuit including:

a voltage divider circuit connected between said output terminal and a reference potential ($V_{SS}$) or ground, and delivering at one output a first divided voltage proportional, in a determined ratio, to said first regulated output voltage ($V_{REG1}$);

a reference cell delivering at one output a determined reference voltage ($V_{REF}$); and a differential amplifier including first and second inputs to which are respectively applied said first divided voltage delivered by the voltage divider circuit and said reference voltage ($V_{REF}$) delivered by the reference cell, the output of this differential amplifier controlling the conduction state of said external regulation device, wherein said control circuit further includes a first high-voltage MOSFET transistor including drain, source and gate terminals respectively connected to the control terminal of the external regulation device, to ground ($V_{SS}$), and to the output of said differential amplifier, said control circuit further including means for delivering a second regulated output voltage ($V_{REG2}$) powering at least said differential amplifier and said reference cell.

11. The regulator circuit according to claim 10, wherein said means include:

a second high-voltage MOSFET transistor including drain, source and gate terminals, the drain and gate terminals of said high-voltage MOSFET transistor being respectively connected to the output terminal of the external regulation device and to a second output of the voltage divider circuit delivering a second divided voltage proportional, in a determined ratio, to said first regulated output voltage ($V_{REG1}$);

a p-channel MOSFET transistor including drain, source and gate terminals, the source terminal of said p-channel MOSFET transistor being connected to the source terminal of the second high-voltage MOSFET transistor, said second regulated output voltage ($V_{REG2}$) being delivered at the drain terminal of said p-channel MOSFET transistor;

a second voltage divider circuit connected between the drain terminal of said p-channel MOSFET transistor and ground ($V_{SS}$), and delivering at one output a divided voltage proportional, in a determined ratio, to said second regulated output voltage ($V_{REG2}$); and a second differential amplifier including first and second inputs to which are respectively applied said divided voltage delivered by said second voltage divider circuit and said reference voltage ($V_{REF}$) delivered by the reference cell, the output of said second differential amplifier being connected to the gate terminal of the p-channel MOSFET transistor, said second differential amplifier being powered by the voltage present at the connection node between the source terminals of said second high-voltage MOSFET transistor and said p-channel MOSFET transistor.

12. The regulator circuit according to claim 11, wherein said first and second high-voltage MOSFET transistors are n-channel MOSFET transistors including a gate oxide having a greater thickness on the drain side than on the source side and a buffer zone on the drain side formed by an n-well.

13. A high-voltage regulator circuit for delivering at least a first regulated output voltage ($V_{REG1}$, $V_{REG}2$) from a high input voltage ($V_{HV}$), this regulator circuit including an external regulation device including an input terminal to which said high input voltage is applied, an output terminal at which said first regulated output voltage is delivered, and a control terminal connected to a control circuit of said external regulation device, this control circuit including:

a voltage divider circuit connected between said output terminal and a reference potential ($V_{SS}$) or ground, and delivering at one output a first divided voltage proportional, in a determined ratio, to said first regulated output voltage ($V_{REG1}$);

a reference cell delivering at one output a determined reference voltage ($V_{REF}$); and a differential amplifier including first and second inputs to which are respectively applied said first divided voltage delivered by the voltage divider circuit and said reference voltage ($V_{REF}$) delivered by the reference cell, the output of this differential amplifier controlling the conduction state of said external regulation device, wherein said control circuit further includes a first high-voltage MOSFET transistor including drain, source and gate terminals respectively connected to the control terminal of the external regulation device, to ground ($V_{SS}$), and to the output of said differential amplifier, said differential amplifier controlling the conduction state of the external regulation device being arranged to have a hysteresis such that said first regulated voltage ($V_{REG1}$) varies between first and second determined voltage levels.

14. The regulator circuit according to claim 13, wherein said control circuit includes an additional high-voltage MOSFET transistor including drain, source and gate terminals, said additional high-voltage MOSFET transistor forming, with said first high-voltage MOSFET transistor, a current mirror, the drain and gate terminals of the additional high-voltage MOSFET transistor being connected together to the gate terminal of the first high-voltage MOSFET transistor and the source terminal of the additional high-voltage MOSFET transistor being connected to ground ($V_{SS}$).

15. The regulator circuit according to claim 14, wherein said first high-voltage MOSFET transistor and said additional high-voltage MOSFET transistor are n-channel MOSFET transistors including a gate oxide having a greater thickness on the drain side than on the source side and a buffer zone on the drain side formed by an n-well.

* * * * *